US008448398B2

(12) United States Patent
Perez et al.

(10) Patent No.: US 8,448,398 B2
(45) Date of Patent: May 28, 2013

(54) VENT WITH SCREEN OR PERFORATED ELEMENT

(75) Inventors: David Perez, Brentwood, CA (US); Richard L. Alsager, Scottsdale, AZ (US)

(73) Assignee: Stockton Products, North Las Vegas, NV (US)

( * ) Notice: Subject to any disclaimer, the term of this patent is extended or adjusted under 35 U.S.C. 154(b) by 0 days.

(21) Appl. No.: 12/901,263

(22) Filed: Oct. 8, 2010

(65) Prior Publication Data

US 2012/0085051 A1 Apr. 12, 2012

(51) Int. Cl.
*E04F 17/00* (2006.01)

(52) U.S. Cl.
USPC ..... 52/302.1; 454/271; 454/276; 52/220.8

(58) Field of Classification Search
USPC ..... 52/302.1, 302.3, 302.7, 202, 203, 52/220.8; 454/237, 241, 243, 270, 271, 275, 454/276
See application file for complete search history.

(56) References Cited

U.S. PATENT DOCUMENTS

| | | | | | |
|---|---|---|---|---|---|
| 1,640,588 | A * | 8/1927 | Yager et al. | ..... | 454/280 |
| 1,764,343 | A * | 6/1930 | Petrelli | ..... | 454/270 |
| 3,220,079 | A * | 11/1965 | Aggson | ..... | 52/302.3 |
| 3,834,577 | A * | 9/1974 | Tempero | ..... | 312/401 |
| 4,026,082 | A * | 5/1977 | Crofoot | ..... | 52/302.7 |
| 4,407,187 | A * | 10/1983 | Horney | ..... | 454/324 |
| 4,550,648 | A * | 11/1985 | Eagle | ..... | 454/260 |
| 4,699,045 | A * | 10/1987 | Hensley | ..... | 454/313 |
| 5,372,543 | A * | 12/1994 | Steele | ..... | 454/184 |
| 5,444,947 | A * | 8/1995 | Miller | ..... | 52/100 |
| 5,460,572 | A * | 10/1995 | Waltz et al. | ..... | 454/273 |
| 6,165,066 | A * | 12/2000 | Sharp et al. | ..... | 454/273 |
| 6,604,994 | B2 * | 8/2003 | Achen | ..... | 454/271 |
| 6,746,324 | B2 * | 6/2004 | Achen | ..... | 454/283 |
| 7,040,979 | B1 * | 5/2006 | Betz | ..... | 454/271 |
| 2001/0032429 | A1 * | 10/2001 | Snyder | ..... | 52/302.1 |
| 2002/0124495 | A1 * | 9/2002 | Layne et al. | ..... | 52/220.1 |
| 2003/0177724 | A1 * | 9/2003 | Botting | ..... | 52/302.1 |
| 2007/0254585 | A1 * | 11/2007 | Achen | ..... | 454/271 |

* cited by examiner

*Primary Examiner* — Robert Canfield
*Assistant Examiner* — Babajide Demuren
(74) *Attorney, Agent, or Firm* — Christie, Parker & Hale, LLP

(57) ABSTRACT

A vent includes an outer element including an outer perforated area having at least one perforation and an inner element having at least one perforation and a peripheral portion. The outer element and the inner element are separated by a distance to define a plenum between the outer element and the inner element.

20 Claims, 4 Drawing Sheets

VENT WITH SCREEN OR PERFORATED ELEMENT

BACKGROUND OF THE INVENTION

The present invention is directed to a vent mounted in a wall of a building, for example an exterior wall or a roof overhang for venting the attic to the outside. Vents are installed to allow for exchange of air in a home or other building. Conventional vents only have one perforated or louvered layer. Consequently, insects, rodents, and other pests, as well as debris such as burning embers, may enter the building via the vents. Some vents have a screen adjoining the interior side of the perforated or louvered outer layer to prevent pests and debris from entering the building. However, the proximity of such a screen to the outer layer indicates that the vent is unable to trap debris such as burning embers within the vent. A better vent therefore is required that will allow for air exchange while reducing the amount of debris and pests entering the building via the vent.

SUMMARY

In an exemplary embodiment, a vent is provided including a first outer element and a second inner element, with a plenum between the two. The first outer element includes a perforated area. The second inner element may be a screen or another perforated element. If the first outer element and the second inner element are both perforated elements, the perforations of the outer and inner elements are preferably axially staggered with respect to each other.

DETAILED DESCRIPTION

Figure 1:
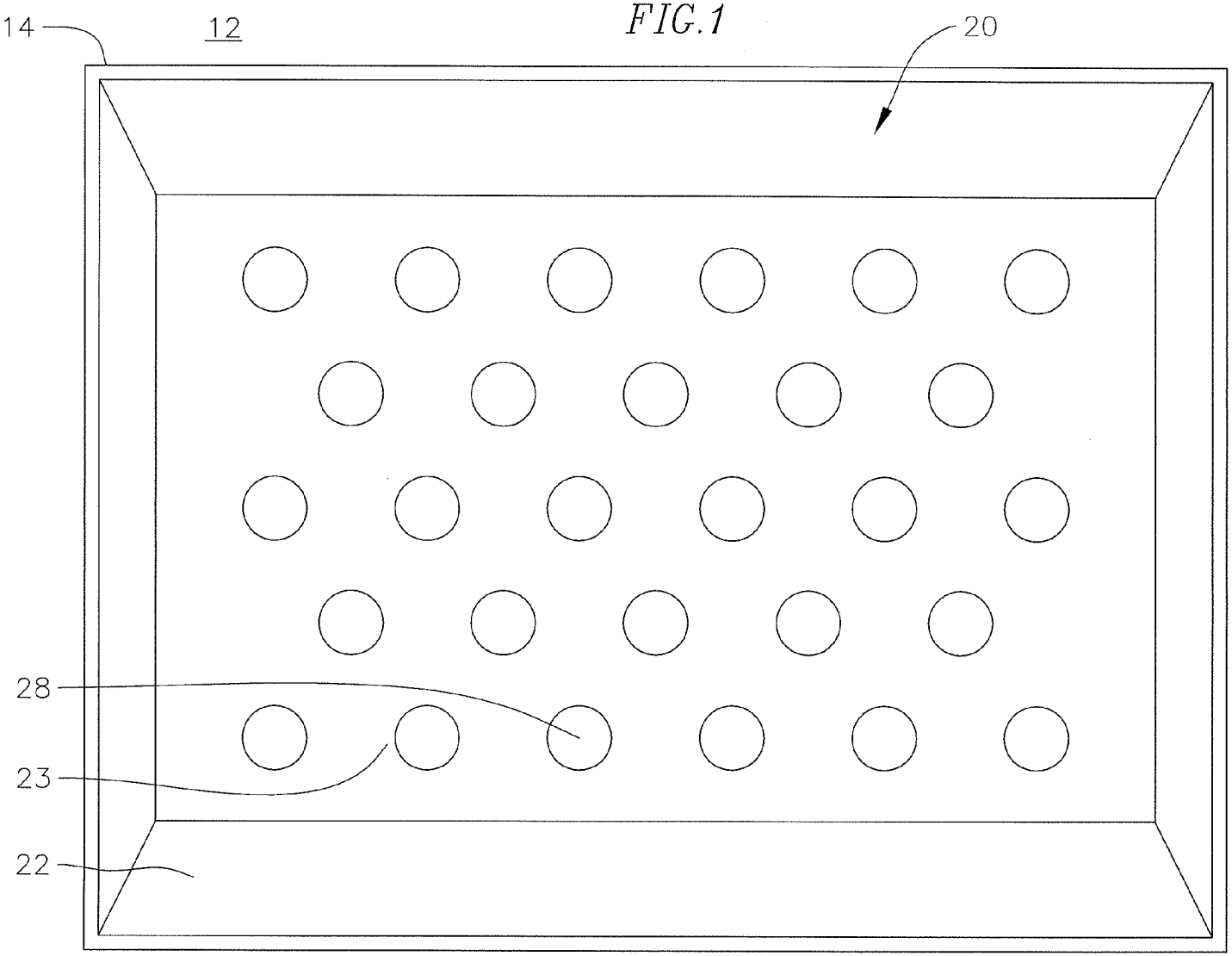
FIG. 1 is a perspective view of an embodiment of the vent installed in a wall.

In an exemplary embodiment, a vent 20 is mounted to a wall 12 having an opening 14, as for example shown in FIG. 1. The vent is provided with an outer element 22 including a perforated area 23 having at least one perforation 28. In one embodiment, the perforated area 23 is an outer perforated plate.

Figure 2:
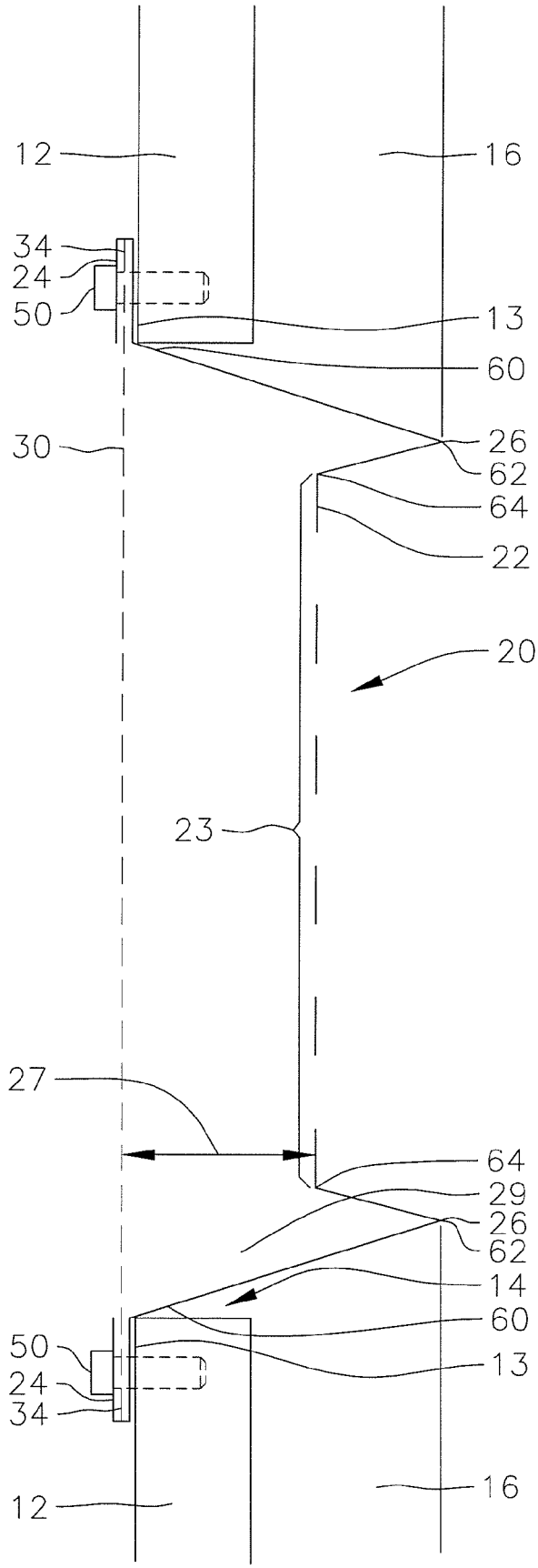
FIG. 2 is a side view of the vent in FIG. 1.
Figure 3:
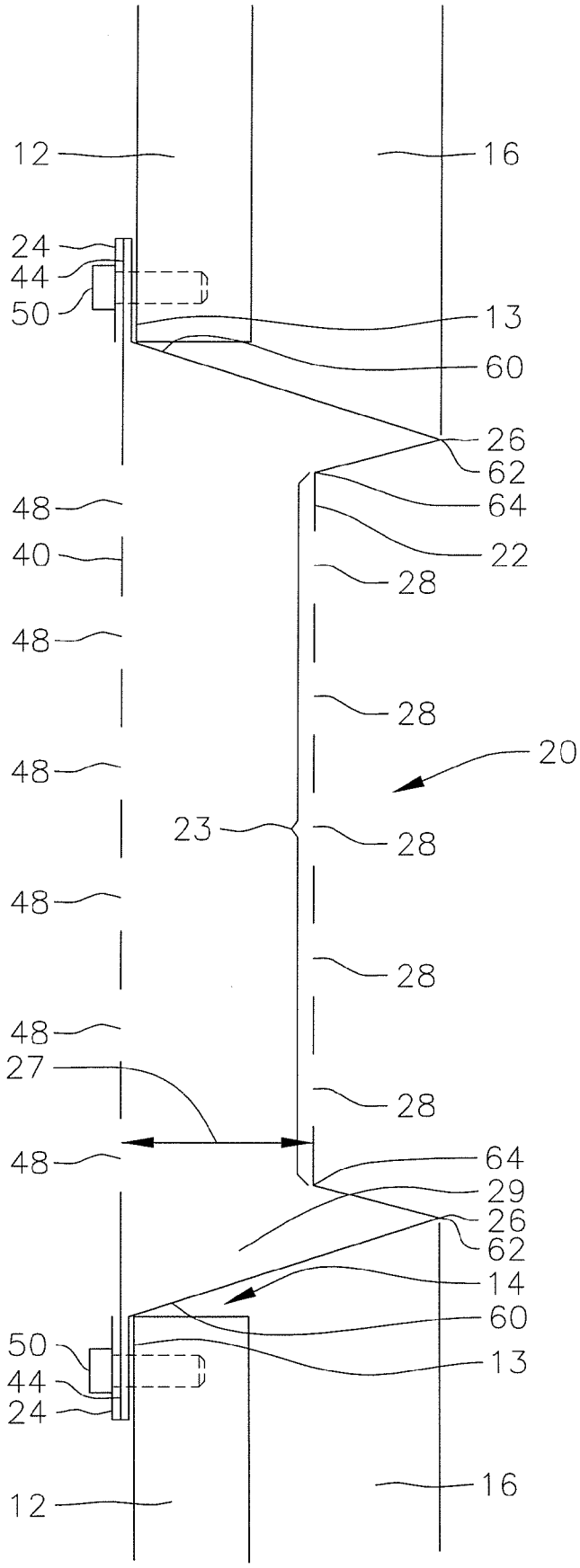
FIG. 3 is a side view of a second embodiment of the vent installed in a wall.
Figure 4:
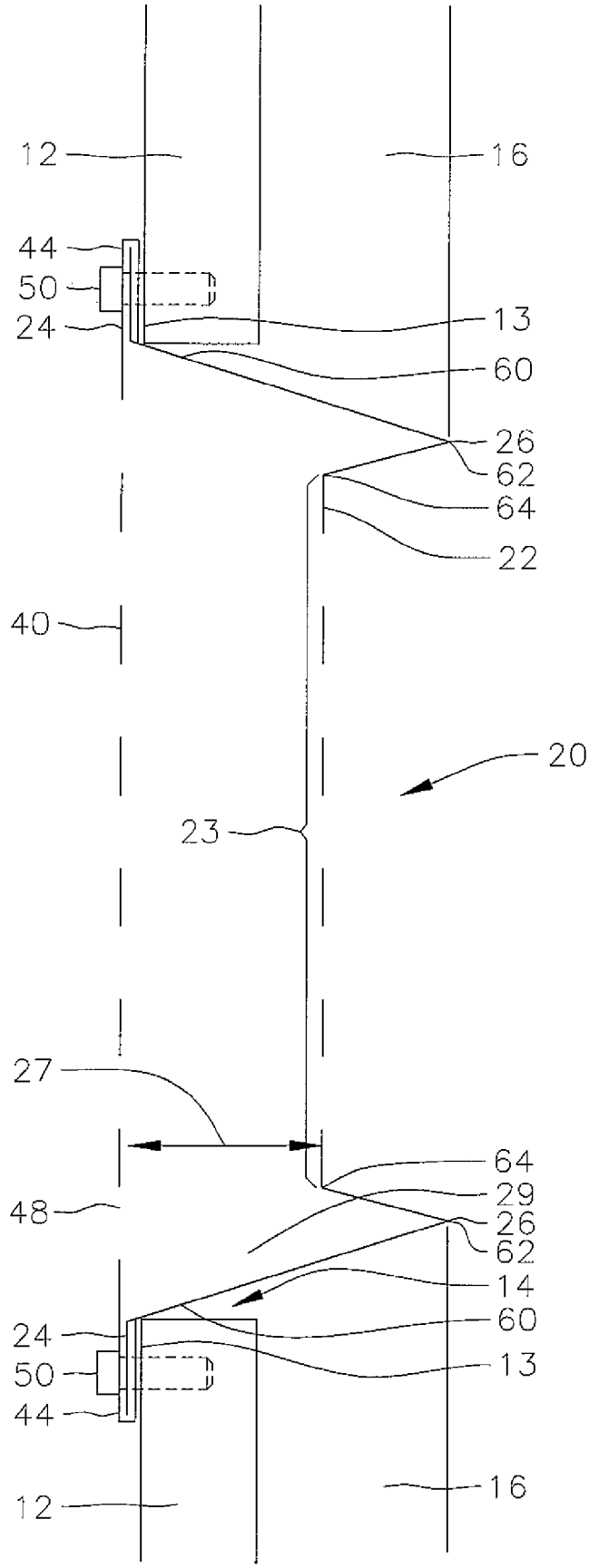
FIG. 4 is a side view of a modified second embodiment of the vent installed in a wall.

As shown in FIGS. 2-4, the outer element 22 of the vent 20 has a series of parallel bends. A first bend 60 defines a flange 24 that is substantially parallel to the wall 12 and lays against the wall 12. In one embodiment, shown in FIGS. 2-4, the flange 24 lays against the interior of the wall 12. In another embodiment, not shown, the flange 24 lays against the exterior of the wall 12. In one embodiment, a second bend 62 defines a high point 26 that extends beyond the exterior plane of the wall 12. In one embodiment, the high point 26 is a guide for laying stucco or other filler material 16 on the exterior of the wall. In another embodiment, not shown, the high point 26 may instead be defined by two bends to form a mesa-type shape. A perforated area 23 is defined between two bends 64. The bends 60, 62 and 64 may be sharp angles, as shown in FIGS. 2-4, 4, or they may be curved or made of multiple angles. In the embodiment shown in FIGS. 2-4, the outer element 22 is symmetric and includes a perforated area 23, two high points 26 and two flanges 24.

In the embodiment shown in FIGS. 2-4, the perforated area 23 is recessed from the high point 26. In other embodiments, the perforated area 23 may be flush with the high point 26 or may even protrude farther from the wall than the high point 26.

The outer element 22 may be integrally formed or may be formed of multiple parts. Multiple parts may be joined together by any suitable method, for example the parts may be welded, brazed, soldered, riveted, adhered, folded, screwed, bolted, wedged, taper fit, forced, or shrink fit together.

In one embodiment, shown in FIGS. 2-4, the perforated area 23 is substantially planar, and the flange 24 and the perforated area 23 are substantially parallel to the wall 12. In other embodiments, not shown, the perforated area 23 is non-planar and may be, for example, pleated or curved. The vent 20 is dimensioned to cover substantially the entirety of the opening 14, while the flange 24 overlaps at least part of the wall 12 defining the periphery 13 of the opening 14.

The vent further includes an inner element 30 or 40 separated from the outer element 22 by a distance 27, as shown in FIGS. 2-4. In one embodiment, the inner element 30 or 40 is substantially parallel to the perforated area 23 of the outer element 22. In one embodiment shown in FIG. 2, the inner element is a screen 30. In a second embodiment shown in FIGS. 3 and 4, the inner element is an inner perforated element 40 having at least one perforation 48. In one embodiment, the inner perforated element 40 is an inner perforated plate. The inner perforated plate may be planar, or it may be non-planar, for example, pleated or curved. The inner element is dimensioned such that the inner element covers substantially the entirety of the opening 14 and the inner element overlaps at least part of the wall 12 defining the periphery 13 of the opening 14. As shown in FIG. 2, a peripheral portion 34 of the screen 30 overlaps at least part of the wall 12 defining the periphery 13 of the opening 14. As shown in FIGS. 3 and 4, a peripheral portion 44 of the inner perforated element 40 overlaps at least part of the wall 12 defining the periphery 13 of the opening 14.

In one embodiment, the screen 30 or the inner perforated element 40 is attached to the outer element 22 by folding and crimping a portion of the flange 24 extending from the outer element 22 over at least part of the peripheral portion 34 or 44 of the inner element 30 or 40, as shown in FIGS. 2 and 3. With this embodiment, at least part of the peripheral portion 34 or 44 is sandwiched between the folded and crimped portion of the flange 24. In another embodiment, at least part of the peripheral portion 44 of the inner element 40 is folded over a portion of at least one of the flanges 24 of the outer element 22 and crimped, as shown in FIG. 4. In yet another embodiment, not shown, at least part of the peripheral portion of the inner element is folded over at least a portion of the flange of the outer element on one edge of the vent and crimped, and at least a portion of the flange of the outer element is folded over at least part of the peripheral portion of the inner element on the other edge of the vent and crimped.

In one embodiment, the vent 20 is positioned within the wall opening 14 and the flange 24, which overlaps at least a part of the wall 12 defining the periphery 13 of the opening 14, is fastened to the wall 12 using at least one fastener 50. In one embodiment, the at least one fastener 50 is a screw that fastens the flange 24 of the outer element 22 to the interior of the wall 12. In another embodiment, other fastener types, such as nails, rivets, etc. that are known in the art may be used.

In one embodiment, not shown, the two peripheral sides of the vent that are perpendicular to the bends 60, 62 and 64 are also attached to the wall 12.

In one embodiment, the length of the vent 20 is 10 feet. In general, the vent 20 may be made in any suitable length.

In one embodiment, after the vent 20 is fastened to the wall 12, filler material 16, such as stucco, is applied to the exterior of the wall 12 and leveled with the high points 26 of the vent 20 to finish the wall surrounding the vent 20. In the embodiments shown in FIGS. 2-4, the high points 26 extend toward the exterior of the building such that the perforated area 23 of the outer element 22 is recessed from the face of the building. In one embodiment, the filler material 16 is stucco. In other embodiments, the filler material 16 may be other building materials known in the art.

The vent 20 is typically used in a house or building to allow air exchange from the outside to the interior of the house or building. For example, the vent may be used in a roof overhang to allow for air exchange between an attic of the building and the outside. The inner element 30 or 40 provides a second barrier to block the intrusion of pests and debris, including hot fire embers. When a screen 30 is used as the inner element, the screen 30 also prevents insects from penetrating through the vent 20 to the interior of the building.

In an exemplary embodiment, as shown in FIG. 3, when the inner element is a perforated element 40, the perforations 28 of the outer element 22 and the perforations 48 of the inner perforated element 40 are preferably axially staggered relative to each other. The perforations 28 of the outer element 22 and the perforations 48 of the inner perforated element 40 are offset to prevent a linear path, orthogonal to the face of the outer element 22, from the exterior of the building, through the vent, to the interior of the building. This staggered configuration reduces the amount of debris penetrating both the outer element 22 and the inner perforated element 40.

The distance 27 between the outer element 22 and the inner element 30 or 40 defines a plenum 29 for trapping any pests or debris that penetrate the perforations 28 of the perforated area 23 of the outer element 22.

The outer element 22 and/or the inner element 30 or 40 may act as a heat sink to dissipate heat from the vent. This allows any hot debris entering the plenum 29, for example fire embers from a fire outside the building, to cool quickly. Rapid cooling of hot embers reduces the risk of the embers igniting other flammable materials. The plenum 29 also prevents hot embers from entering the structure.

In an exemplary embodiment, the outer element 22 and the inner perforated element 40 are made from galvanized steel. In other embodiments, the outer element 22, the inner perforated element 40, and/or the screen 30 may be made from galvanized steel, aluminum, copper, stainless steel, or other suitable materials.

The preceding description has been presented with reference to various embodiments of the invention. Persons skilled in the art and technology to which this invention pertains will appreciate that alterations and changes in the described structures and methods of operation can be practiced without meaningfully departing from the principles, spirit, and scope of this invention.

What is claimed is:

1. A vent comprising:

an outer element comprising, an outer perforated area comprising at least one perforation, a first wall extending from the outer perforated area, a second wall extending from the outer perforated area and spaced apart from the first wall;

a first flange extending from the first wall, a second flange extending from the second wall in a direction opposite the first flange, a third wall extending from the outer perforated area to the first wall, and a fourth wall extending from the outer perforated area to the second wall, wherein the outer perforated area, the first wall, the second wall, the third wall, the fourth wall, the first flange and the second flange are integrally formed from a single piece of material, wherein said single piece of material is bent proximate opposite ends of the outer perforated area in at least a direction away from said outer perforated area to define the third wall and the fourth wall spaced apart from the third wall and extending from the outer perforated area in at least a direction away from said outer perforated area, and wherein said single piece of material is bent again at different locations to define said first wall extending from said third wall and said second wall extending from said fourth wall, wherein said first and second walls extend in at least a direction toward and beyond said outer perforated area, and wherein said single piece of material is bent again at different locations to form the first flange extending from said first wall and the second flange extending from said second wall and opposite said first flange; and an inner element comprising at least one perforation and a peripheral portion, wherein the inner element is coupled to the first and second walls and separated from the outer element by a distance to define a plenum between the outer element and the inner element.

2. The vent according to claim 1, wherein the inner element is a screen, wherein said screen defines a plurality of perforations.

3. The vent according to claim 1, wherein the inner element comprises a plurality of perforations formed there through.

4. The vent according to claim 3, the outer perforated area comprises a plurality of perforations, wherein each perforation of the plurality of perforations of the inner perforated element is axially offset from all the perforations of the outer perforated area.

5. The vent according to claim 1, wherein the outer element comprises a material selected from the group consisting of galvanized steel, aluminum, copper and stainless steel.

6. The vent according to claim 1, wherein the inner element comprises a material selected from the group consisting of galvanized steel, aluminum, copper and stainless steel.

7. A vented wall of a building comprising:

a wall comprising an opening; and a vent within the opening and comprising:

an outer element comprising, an outer perforated area comprising at least one perforation, a first wall extending from the outer perforated area, a second wall extending from the outer perforated area and spaced apart from the first wall, a first flange extending from the first wall, a second flange extending from the second wall in a direction opposite the first flange, a third wall extending from the outer perforated area to the first wall, and a fourth wall extending from the outer perforated area to the second wall, wherein the outer perforated area, the first wall, the second wall, the third wall, the fourth wall, the first flange and the second flange are integrally formed from a single piece of material, wherein said single piece of material is bent proximate opposite ends of the outer perforated area in at least a direction away from said outer perforated area to define the third wall and the fourth wall, spaced apart from the third wall, and extending from the outer perforated area in at least a direction away from said outer perforated area, and wherein said single piece of material is bent again at different locations to define said first wall extending from said third wall and said second wall extending from said fourth wall, wherein said first and second walls extend in at least a direction toward and beyond said outer perforated area, and wherein said single piece of material is bent again at different locations to form the first flange extending from said first wall and the second flange extending from said second wall and opposite said first flange;

an inner element comprising at least one perforation and a peripheral portion, wherein the inner element interfaces with the first and second flanges;

a first fastener fastening said first flange and a first portion of the inner element interfacing with the first flange to the wall; and a second fastener fastening said second flange and a second portion of the inner element interfacing with said second flange to the wall.

8. The vented wall of claim 7, wherein the vent comprises a material selected from the group consisting of galvanized steel, aluminum, copper and stainless steel.

9. The vented wall of claim 7, wherein at least one of the inner element and the outer perforated area is substantially parallel to the wall.

10. The vented wall of claim 7, wherein at least part of the first portion of the inner element is bent around at least a portion of the first flange of the outer element to join the outer element with the inner element.

11. The vented wall of claim 7, wherein at least a portion of the first flange of the outer element is bent around at least part of the first portion of the inner element to join the outer element with the inner element.

12. The vent according to claim 1, wherein the flanges provide a surface for attaching said vent to a wall.

13. The vent according to claim 1, wherein the inner element is mounted on the flanges.

14. The vent according to claim 1, wherein at least part of the first portion of the inner element is bent around at least a portion of the first flange of the outer element to join the outer element with the inner element.

15. The vent according to claim 1, wherein at least a portion of the first flange of the outer element is bent around at least part of the first portion of the inner element to join the outer element with the inner element.

16. The vented wall of claim 7, further comprising a filler over the wall and surrounding said vent, wherein the intersections between the third and first walls and between the fourth and second walls are flush with an outer surface of said filler.

17. The vented wall of claim 16, wherein the filler material is stucco.

18. The vented wall of claim 7, wherein the outer perforated area comprises a plurality of perforations, and wherein the inner element comprises a plurality of perforations wherein each perforation of the inner perforated element is axially offset from all perforations of the outer perforated area.

19. The vented wall of claim 7, wherein the inner element is a screen, and wherein said screen defines a plurality of perforations.

20. The vented wall according to claim 7, wherein the inner element is mounted on the flanges.

* * * * *